US005157250A

United States Patent [19]

Oikari et al.

[11] Patent Number: 5,157,250

[45] Date of Patent: Oct. 20, 1992

[54] PHOTOMULTIPLIER HAVING GAIN STABILIZATION MEANS

[75] Inventors: Timo Oikari, Turku; Jarmo Nurmi, Kuusisto, both of Finland

[73] Assignee: Wallac Oy, Turku, Finland

[21] Appl. No.: 663,854

[22] PCT Filed: Aug. 29, 1989

[86] PCT No.: PCT/FI89/00159

§ 371 Date: Mar. 11, 1991

§ 102(e) Date: Mar. 11, 1991

[87] PCT Pub. No.: WO90/02415

PCT Pub. Date: Mar. 8, 1990

[30] Foreign Application Priority Data

Aug. 31, 1988 [SE] Sweden ..... 8803042

[51] Int. Cl.[5] ..... H01J 40/14

[52] U.S. Cl. ..... 250/207

[58] Field of Search ..... 250/207, 213 VT, 214 AG; 313/103 CM, 105 CM, 532-536

[56] References Cited

U.S. PATENT DOCUMENTS

| | | | |
|---|---|---|---|
| 3,183,353 | 5/1965 | Baldwin | 250/207 |
| 3,714,441 | 1/1973 | Kreda | 250/207 |
| 4,661,693 | 4/1987 | Masanobu | 250/207 |
| 5,004,904 | 4/1991 | Yamakawa et al. | 250/207 |

*Primary Examiner*—David C. Nelms
*Assistant Examiner*—Michael Messinger
*Attorney, Agent, or Firm*—Armstrong & Kubovcik

[57] ABSTRACT

A gain stabilization system for photomultiplier tubes using a pulsed light source, preferably a light emitting diode (LED), the signal of which is detected at the first dynode and at the anode. The gain of the photomultiplier tube is stabilized by keeping the ratio between the two signals constant.

4 Claims, 2 Drawing Sheets

PHOTOMULTIPLIER HAVING GAIN STABILIZATION MEANS

BACKGROUND OF THE INVENTION

1. Field of the Invention

The present invention relates generally to photomultiplier tubes and, more particularly, to an automatic gain stabilization system for use with them. The method utilizes a light source, preferably a light emitting diode (LED), the signal of which is detected both at the first dynode and at the anode. By keeping the ratio between these two signals constant the actual gain of the photomultiplier tube is stabilized and possible drifts in the intensity of the light source are eliminated.

2. Description of the Prior Art

Photomultiplier tubes, or shortly photomultipliers, are common instruments in science and technology for detecting weak light levels. The photomultiplier consists of a photosensitive cathode, a chain of secondary emission electrodes called dynodes and an output electrode called anode with electric potentials arranged between them. The operation principle is as follows: Light flux hits the cathode which converts light photons into free electrons. The applied voltage directs them to the first dynode, from which every electron liberates several secondary electrons in a process called secondary emission. These are in turn directed to the next dynode, where the secondary emission is repeated and so on. The result is amplification by electron multiplication so that after the dynode chain the signal taken from the anode is high enough to be handled electronically. In some applications one of the later dynodes can be used as an output electrode.

An important quantity associated with photomultipliers is their amplification, or gain, defined as the ratio of anode current to cathode current and is typically $10^5$–$10^9$ depending on the number of dynodes, interdynode voltages and dynode materials. The gain should, naturally, remain stable during operation to yield ideal performance for the light detecting device. Unfortunately, this is not normally achieved but the gain tends to drift with temperature, variable light fluxes and ageing of the photomultiplier.

For correcting the gain instabilities a known solution is to employ a supplementary pulsed light source with standardized intensity to monitor the output of the photomultiplier and to adjust the gain according to the obtained signal by e.g. a feedback loop as presented by Ried and Gilland (U.S. Pat. No. 3,515,878). The pulsed light source can be e.g. a low-intensity lamp, a light emitting diode (LED) or a radioactive isotope in conjunction with appropriate scintillator.

A problem with mentioned stabilization light sources is that they, too, are susceptible to instabilities. These can be caused by thermal drifts, ageing, and alterations in reflective and/or absorptive properties in materials surrounding the light source-photomultiplier assembly. Consequently, the photomultiplier gain can never be more stable than the used stabilization light source. Accordingly, there is a need for a gain stabilization method that is not sensitive to drifts in the stabilization light sources. The present invention meets this requirement.

SUMMARY OF THE INVENTION

The present invention provides a gain stabilization system for photomultiplier tubes that is insensitive to drifts encountered with stabilization light sources.

By definition, the gain of the photomultiplier is the ratio between the anode current and the cathode current. This is equivalent to the ratio between the number of electrons at the anode and the number of electrons hitting the first dynode. The applicants have found that the signal of a LED emitting a few thousand photons in a flash with duration of some hundred nanoseconds is electronically detectable at the first dynode and, naturally, at the anode. By stabilizing the ratio between these two signals the actual gain of the photomultiplier is stabilized and effects of possible drifts in the intensity of the stabilization source are eliminated.

DESCRIPTION OF THE PREFERRED EMBODIMENTS

Figure 1:
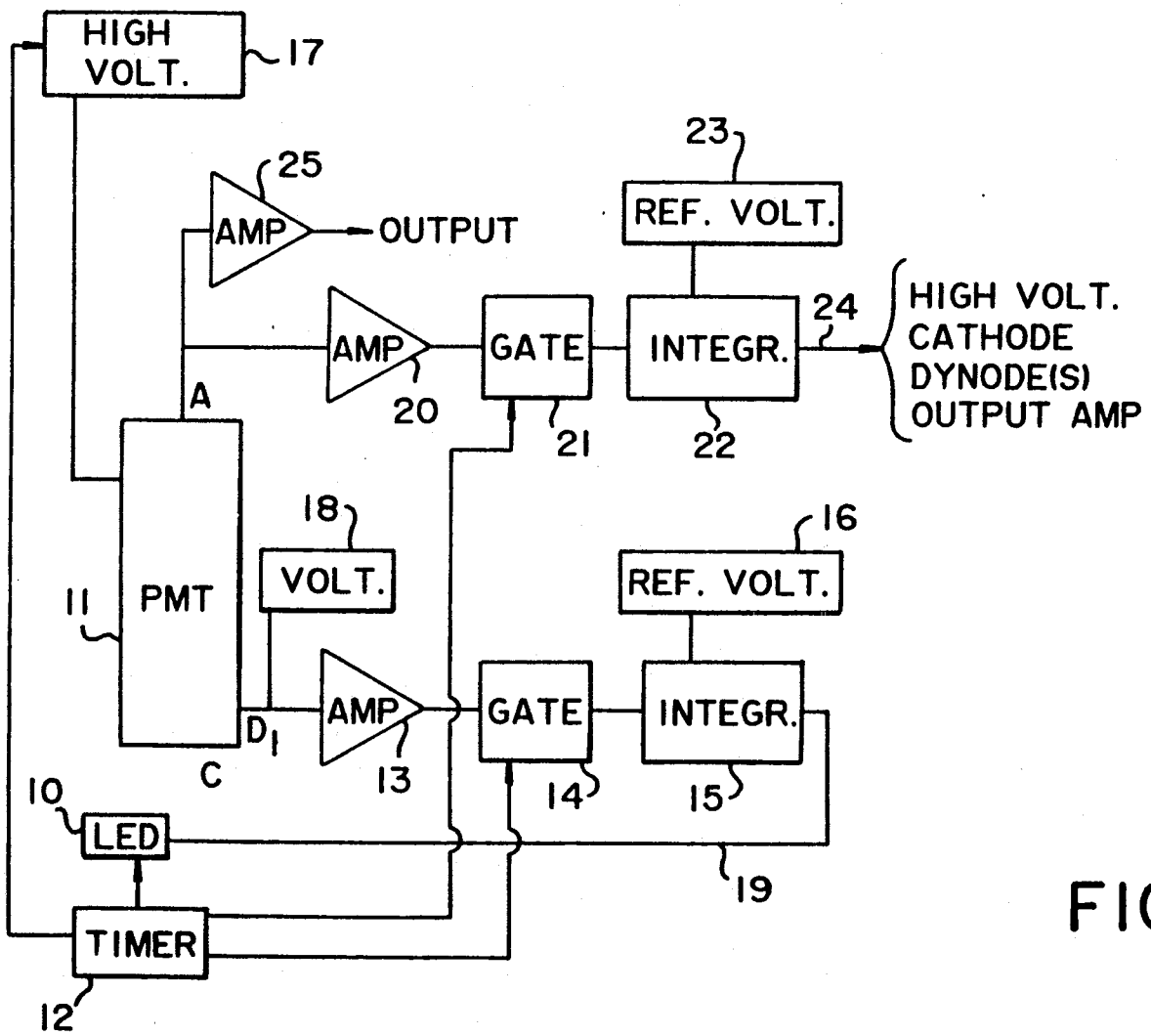
FIG. 1 is a block diagram of one embodiment of the invention
Figure 2:
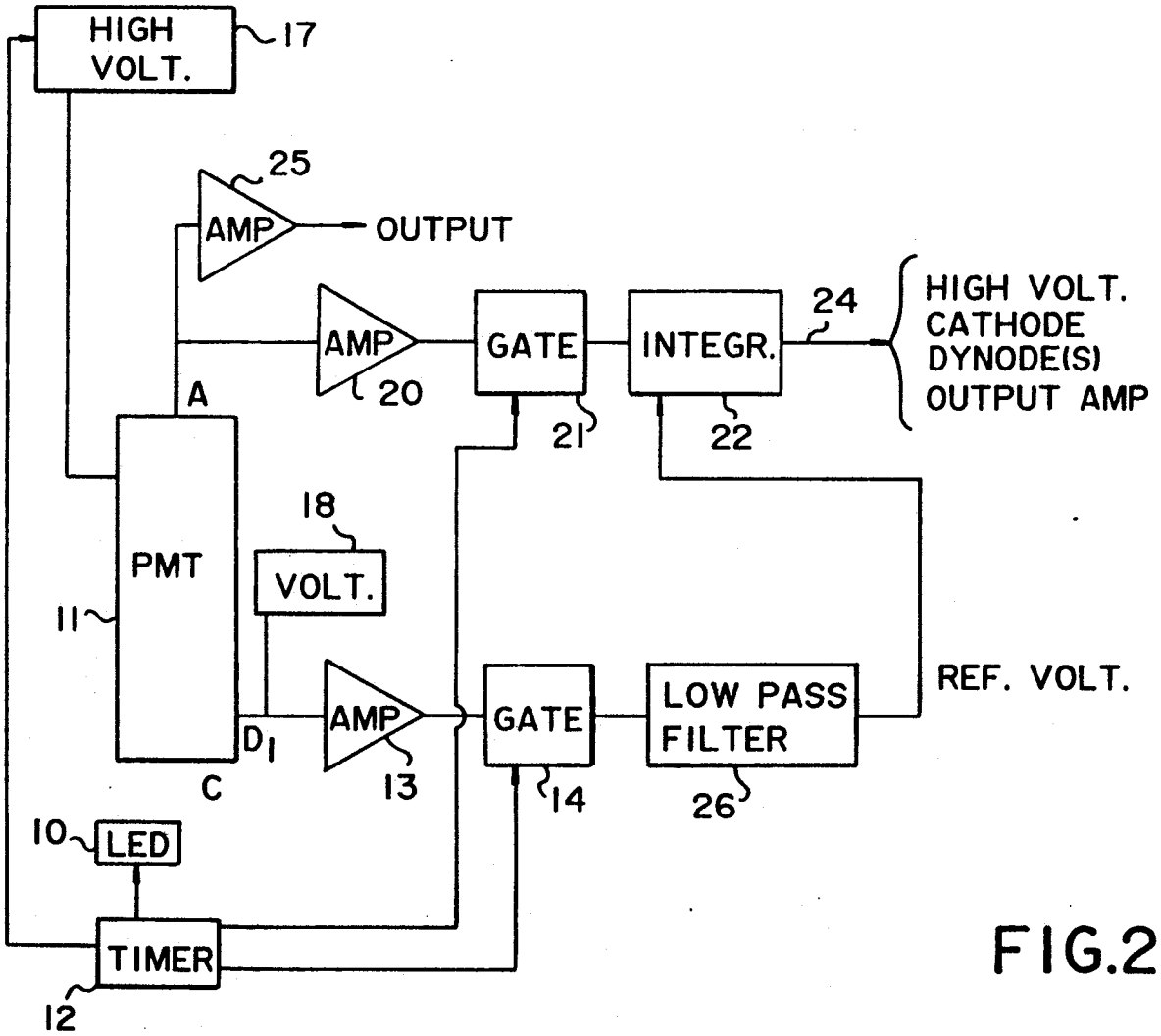
FIG. 2 is a block diagram of another embodiment of the invention.

The electronic circuitry presented by blocks in FIG. 1 and FIG. 2 is well known and can easily be constructed by those skilled in the art. That is why the units themselves are not described, only their connection with the overall system operation.

The gain stabilization cycle consists of two phases: first, detection of the signal produced by the stabilization source at, preferably, the first dynode; second, detection of the signal produced by the stabilization source at the output electrode, most commonly the anode. In the first phase the potentials of the rest of the tube are switched off to eliminate the high amplitude signals from the later dynodes which otherwise would get summed onto the first dynode signal through capacitive coupling. In the second phase the photomultiplier operates normally and the actual measurement takes place then.

One embodiment of the invention is presented in FIG. 1. The signals of flashes of a light source 10 are detected by a photomultiplier tube 11 having a cathode (C), chain of dynodes ($D_1$–$D_n$) and an anode (A). The light source 10 can be e.g. a low intensity lamp, a scintillating radioactive source or, preferably, a light emitting diode (LED) because of its simple use and control. A flash comprises typically some thousands of photons emitted in some hundreds of nanoseconds. The timing of the flashes is arranged with a multi-functional timer unit 12.

For the first phase the timer 12 switches off the potentials from the second dynode onwards by gating off the high voltage supply 17. A separate voltage source 18 maintains the potential difference between the cathode and the first dynode.

The signals of the flashes are then taken from the first dynode $D_1$ through an amplifier 13. A controllable gate 14 is opened by the timer 12 enabling the signals to be fed to an integrator 15. The integrator 15 compares the signal to a preset reference voltage 16 and adjusts the intensity of the light source 10 with a feedback loop 19 so that the signal produced by the light source 10 at the first dynode is kept constant. Several flashes are accumulated in succession to overcome the noise in electronic components.

After a predetermined number of flashes the timer 12 shuts the gate 14 thus ending the adjustment of the light source 10 that is thereafter operated with the reached intensity. After that the timer 12 switches on the potentials of the rest of the photomultiplier tube rendering it to operate normally for the actual measurement and the second phase of the stabilization cycle.

During the second phase the photomultiplier operates normally. At predetermined times the timer 12 interrupts the actual measurement and operates the light source 10 the signal of which is taken from the output electrode, most commonly from the anode, amplified by an amplifier 20 and fed to an integrator 22 through a controllable gate 21 opened by the timer 12. The integrator 22 compares the signal to a preset reference voltage 23 and, if needed, adjusts the gain of the photomultiplier with a feedback loop 24 by adjusting either high voltage supply 17, potential of the cathode, potential(s) of some dynode(s) or the amplification of the output amplifier 25. The result is that the signal produced by the light source at the output is kept constant.

The stabilization cycles are repeated in predetermined intervals. Because both the $D_1$-signal and the output signal are kept constant with respect to each other the ratio between the two signals remains also constant and the gain of the photomultiplier gets stabilized.

Another embodiment of the invention is presented in FIG. 2. Many of its blocks are identical with those in FIG. 1 and same numerals are used for them. During the first phase of the stabilization cycle the intensity of the light source 10 is not adjusted but its signal from the first dynode is fed into a low pass filter 26, the output of which acts as a reference voltage for the integrator 22 during the second phase. The output of the low pass filter 26 is proportional to the intensity of the light source 10 and possible changes in that intensity are converted to changes in the reference voltage for the integrator 22. The result after the second phase is that the output of the integrator 22 gets in fixed relation to the $D_1$-signal and the gain of the photomultiplier gets stabilized.

We claim:

1. A photomultiplier having a plurality of dynodes and a gain stabilization means, said gain stabilization means comprising:

a light source for producing light flashes to be detected by the photomultiplier, means connected to a first dynode of said plurality of dynodes of the photomultiplier for detecting first voltage signals produced by said light flashes at said first dynode, means connected to a second dynode of said plurality of dynodes or the anode of the photomultiplier for detecting second voltage signals produced by said light flashes at said second dynode or said anode, and means for adjusting the photomultiplier voltage so that said first voltage signals and said second voltage signals remain in fixed relationship with each other.

2. A photomultiplier having a plurality of dynodes and a gain stabilization means, said gain stabilization means comprising:

a light source for producing light flashes to be detected by the photomultiplier, means connected to a first dynode or said plurality of dynodes of the photomultiplier for detecting first voltage signals produced by said light flashes at said first dynode, means for sensing a difference between said first voltage signals and a first reference voltage and adjusting the intensity of said light source until said difference is zero, means connected to a second dynode of said plurality of dynodes or he anode of the photomultiplier for detecting second voltage signals produced by said light flashes at said second dynode or said anode, and means for sensing a difference between said second voltage signals and a second reference voltage and adjusting the photomultiplier voltage until said difference is zero, said second reference voltage having a predetermined relationship to said first reference voltage.

3. A photomultiplier having a plurality of dynodes and a gain stabilization means, said gain stabilization means comprising:

a light source for producing light flashes to be detected by the photomultiplier, means connected to a first dynode of said plurality of dynodes of the photomultiplier for detecting first voltage signals produced by said light flashes at said first dynode, means connected to a second dynode of said plurality of dynodes or the anode of the photomultiplier for detecting second voltage signals produced by said light flashes at said second dynode for said anode, and means for sensing a difference between said first voltage signals and a firs reference voltage and adjusting the intensity of said light source until said difference is zero.

4. A photomultiplier according to claims 1, 2 or 3, further comprising means for deactivating at least a third dynode of said plurality of dynodes when detecting said first voltage signal.

* * * * *